US006155615A

United States Patent [19]

Schultz

[11] Patent Number: 6,155,615

[45] Date of Patent: Dec. 5, 2000

[54] TILT-LATCH FOR A SASH WINDOW

[75] Inventor: Steven E. Schultz, Demotte, Ind.

[73] Assignee: Ashland Products, Inc., Lowell, Ind.

[21] Appl. No.: 09/121,289

[22] Filed: Jul. 22, 1998

[51] Int. Cl.[7] ..... E05C 1/08

[52] U.S. Cl. ..... 292/163; 292/DIG. 47; 292/175; 49/183

[58] Field of Search ..... 49/183, 181, 184; 292/175, 163, 42, 164, 145, DIG. 47

[56] References Cited

U.S. PATENT DOCUMENTS

| | | |
|---|---|---|
| 16,228 | 12/1856 | Copeland . |
| 1,781,729 | 11/1930 | Major . |
| 2,568,273 | 9/1951 | Clark . |
| 2,965,935 | 12/1960 | Olsen . |
| 3,080,621 | 3/1963 | Mendelsohn . |
| 3,122,797 | 3/1964 | Segre . |
| 4,167,835 | 9/1979 | Nobes et al. . |
| 4,400,026 | 8/1983 | Brown, Jr. . |
| 4,475,311 | 10/1984 | Gibson . |
| 4,553,353 | 11/1985 | Simpson . |
| 4,578,903 | 4/1986 | Simpson . |
| 4,581,850 | 4/1986 | Simpson . |
| 4,622,778 | 11/1986 | Simpson . |
| 4,669,765 | 6/1987 | Ullman . |
| 4,790,579 | 12/1988 | Maxwell et al. . |
| 4,791,756 | 12/1988 | Simpson . |
| 4,824,154 | 4/1989 | Simpson . |
| 4,837,975 | 6/1989 | Simpson . |
| 4,901,475 | 2/1990 | Simpson . |
| 4,917,413 | 4/1990 | Jason et al. . |
| 5,028,083 | 7/1991 | Mischenko . |
| 5,068,932 | 12/1991 | Chang . |
| 5,096,240 | 3/1992 | Schultz . |
| 5,121,951 | 6/1992 | Harbom et al. . |
| 5,121,952 | 6/1992 | Jason . |
| 5,139,291 | 8/1992 | Schultz . |
| 5,165,737 | 11/1992 | Riegelman . |
| 5,618,067 | 4/1997 | Carlson et al. . |
| 5,669,639 | 9/1997 | Lawrence . |
| 5,671,958 | 9/1997 | Szapucki et al. . |

*Primary Examiner*—B. Dayoan
*Assistant Examiner*—Gary Estremsky
*Attorney, Agent, or Firm*—Wallenstein & Wagner, Ltd.

[57] ABSTRACT

A tilt-latch (10) adapted for releasably securing a pivotable sash window (12) disposed within opposed guide rails (16) on a master frame (14) of a window sash assembly (11) is disclosed. The sash window (12) comprises a top sash rail (20), a base (22) and two stiles (24,26) connected together at their extremities. The tilt-latch (10) comprises a housing (42) adapted to be supported by the top rail (20). The housing (42) has an outward end opening (44) and a tongue (76) extending along a bottom wall (45) of the housing (42). The housing (42) also has a cover (51) having an elongated opening (70) defining a pair of rails (72,74). The housing (42) further has an outer edge (110). A latch bolt (46) is disposed within the housing (42) and has a nose (47) adapted for engaging a respective one of the guide rails (16). The latch bolt (46) has a first bolt channel (82) in cooperative sliding engagement with the first tongue (76). The tilt-latch (10) also has means for biasing the latch bolt (46) through the outward end opening (44). An actuator (48) is connected to the latch bolt (46) and has an actuator channel (100,102) on opposed longitudinal edges (96,98) of the actuator (48) that cooperate with the elongated opening rails (72,74) wherein the actuator (48) is slideable along the cover (50) to retract the latch bolt (46) into the housing (42). A portion of the actuator (48) moves past the outer edge (110) when retracting the latch bolt (46) into the housing (42).

77 Claims, 8 Drawing Sheets

TILT-LATCH FOR A SASH WINDOW

DESCRIPTION

1. Technical Field

The present invention relates to a tilt-latch for a pivotal sash window assembly and, more particularly to a tilt-latch mounted substantially flush in a top sash rail of a pivotal sash window.

2. Background of the Invention

A pivotal sash window adapted for installation in a master frame of a sash window assembly is well-known. The sash window assembly typically has opposed, vertically extending guide rails to enable vertical reciprocal sliding movement of the sash window in the master frame while cooperatively engaged with the guide rails. The sash window has a top sash rail, a base and a pair of stiles cooperatively connected together at adjacent extremities thereof to form a sash frame, usually a rectangular frame. Typically, a pair of spaced tilt-latches are installed on, or in, opposite ends of the top sash rail.

Each tilt-latch is generally comprised of a housing having an outward end opening and a latch bolt disposed within the housing. A spring disposed within the housing generally biases the latch bolt through the outward end opening to engage the guide rails of the master frame. The latch bolt has a control button to allow for actuation of the latch bolt. An operator can use his finger to engage the button and actuate the latch bolt wherein the latch bolt is retracted into the housing. This releases the latch bolt from the guide rail. When the latch bolts of the opposed tilt-latches are actuated simultaneously, the sash window can then be pivoted from the master frame.

A tilt-latch mounted in a top sash rail is typically called a flush-mount tilt-latch. An example of this type of tilt-latch is shown in U.S. Pat. No. 5,139,291, assigned to Ashland Products, Inc., the assignee of the present invention. To accommodate the flush-mount tilt-latch in the top rail, a slot is punched or routed in the top rail. Because material is removed from the top rail, the structural integrity of the top rail is decreased. The greater the length of the tilt-latch, the greater the amount of material that is required to be removed from the top rail, and thus, the greater effect on the structural integrity of the top rail.

As discussed, the window sash is fixed to the master frame by the nose of the latch bolt that engages the guide rail of the master frame. When wind forces act upon the window sash, a moment can be created about the point where the nose engages the guide rail. A moment arm associated with this moment corresponds to the length of the tilt-latch. The greater the length of the tilt-latch, the greater the moment that can be generated. This can possibly result in the latch bolt nose disengaging from the guide rail allowing the sash window to pivot uncontrollably from the master frame. Also, because holes have been punched into the top rail to accommodate the tilt-latches, a bowing of the top rail could occur under sufficient wind conditions. The wind forces may apply a twisting force on the tilt-latch in the top rail. Wind forces acting on the sash window may also apply torsional forces between the latch bolt and the housing.

The present invention is provided to solve these and other problems.

SUMMARY OF THE INVENTION

It is an object of the present invention to provide a tilt-latch adapted for releasably securing a pivotable sash window to a master frame of a sash window assembly.

The master frame has opposed, vertically extending guide rails. The sash window has a top sash rail, a base and a pair of stiles cooperatively connected together at adjacent extremities to form a frame. The top sash rail includes a pair of opposing header slots. Each of the header slots forms a pair of opposing, longitudinal header rails.

In accordance with one aspect of the invention, the tilt-latch has a housing adapted to be supported by the top rail. The housing has an outward end opening and an outer edge. A latch bolt is supported within the housing and has a nose adapted for engaging a respective one of the guide rails. The latch bolt moves past the outer edge of the housing when the latch bolt is retracted into the housing.

In accordance with another aspect of the invention, the tilt-latch has a housing adapted to be supported by the top rail. The housing has an outward end opening and a tongue extending from the housing. A latch bolt is disposed within the housing and has a nose adapted for engaging a respective one of the guide rails. The latch bolt has a channel that is in cooperative sliding engagement with the tongue.

According to another aspect of the invention, the tilt-latch further includes means for biasing the latch bolt through the outward end opening.

According to a further aspect of the invention, an actuator is connected to the latch bolt wherein the actuator can retract the latch bolt into the housing. If desired, the latch bolt could be designed to be actuated without requiring a separately connected actuator. An actuator could also be integrally molded with the latch bolt or attached separately.

According to another aspect of the invention, the tongue extends along a bottom wall of the housing and is spaced from sidewalls of the housing. The tongue preferably extends substantially along the entire length of the bottom wall of the housing.

According to a further aspect of the invention, the tongue has a flange extending transversely from the tongue and the latch bolt channel is in cooperative sliding engagement with the tongue and the flange.

According to yet a further aspect of the invention, the housing further includes a second tongue extending from a sidewall of the housing. The latch bolt has a second channel in cooperative sliding engagement with the second tongue.

According to another aspect of the invention, the housing further includes a cover and a pair of sidewalls depending from the cover. The cover has an elongated opening in communication with a peripheral opening. The elongated opening defines a pair of rails. The actuator has an actuator channel on opposed edges of the actuator that cooperate with the elongated opening rails wherein the actuator is slideable along the cover. A rear portion of the actuator slides through the peripheral opening. The latch bolt also has a post and the actuator has a notch. The post is received in the notch to connect the actuator to the latch bolt.

According to another aspect of the invention, the housing has an outer edge. The actuator or latch bolt moves past the outer edge of the housing when the latch bolt is retracted into the housing.

According to another aspect of the invention, the biasing means comprises a spring. The latch bolt has a spring surface and the spring has one end abutting the spring surface and another end abutting the housing. The tongue and the flange extending from the tongue substantially encapsulate a length of the spring.

Other features and advantages of the invention will be apparent from the following specification taken in conjunction with the following drawings.

DETAILED DESCRIPTION

Figure 1:
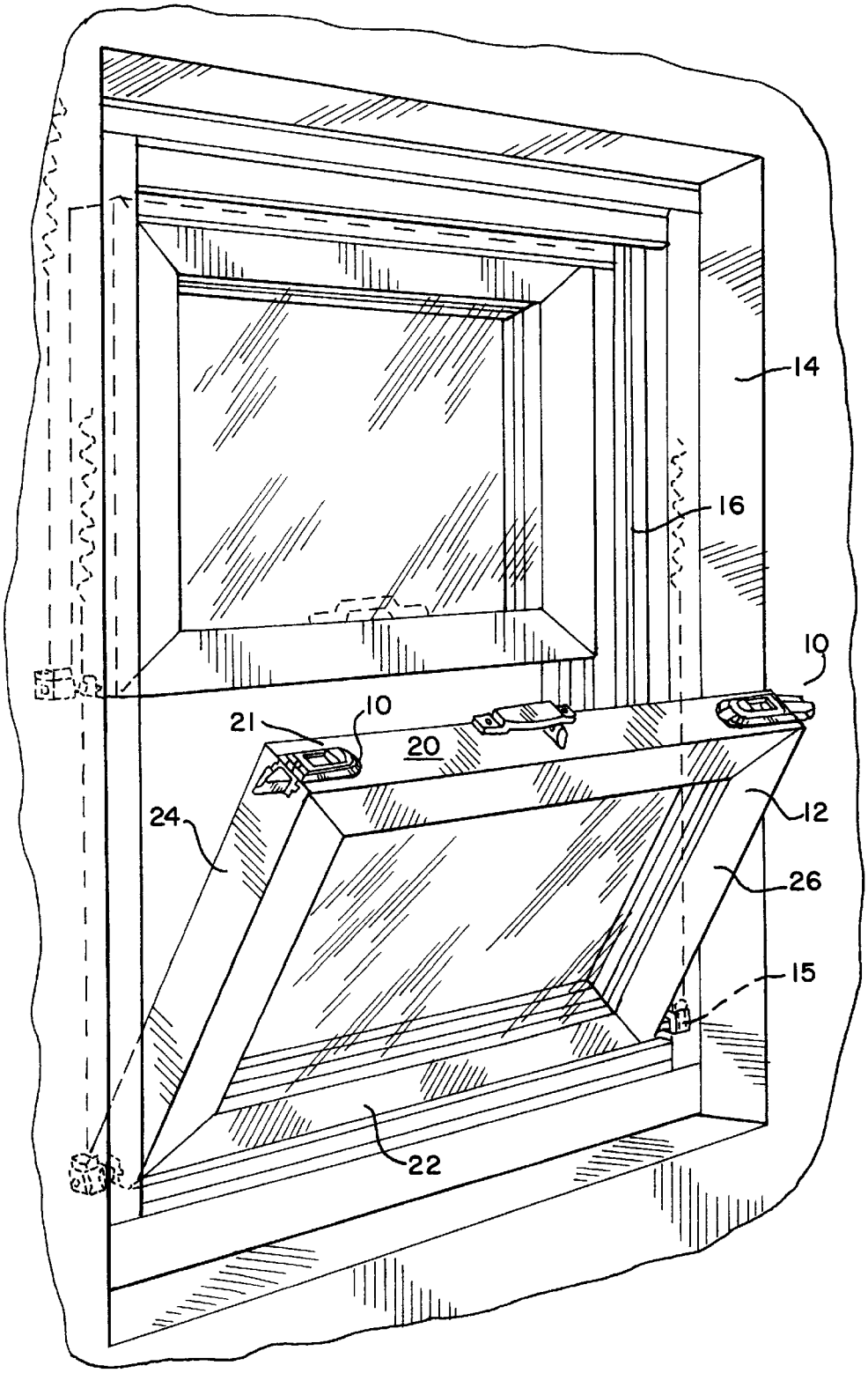
FIG. 1 is a perspective view of a double-hung sash window assembly utilizing a tilt-latch according to the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figures 2, 3:
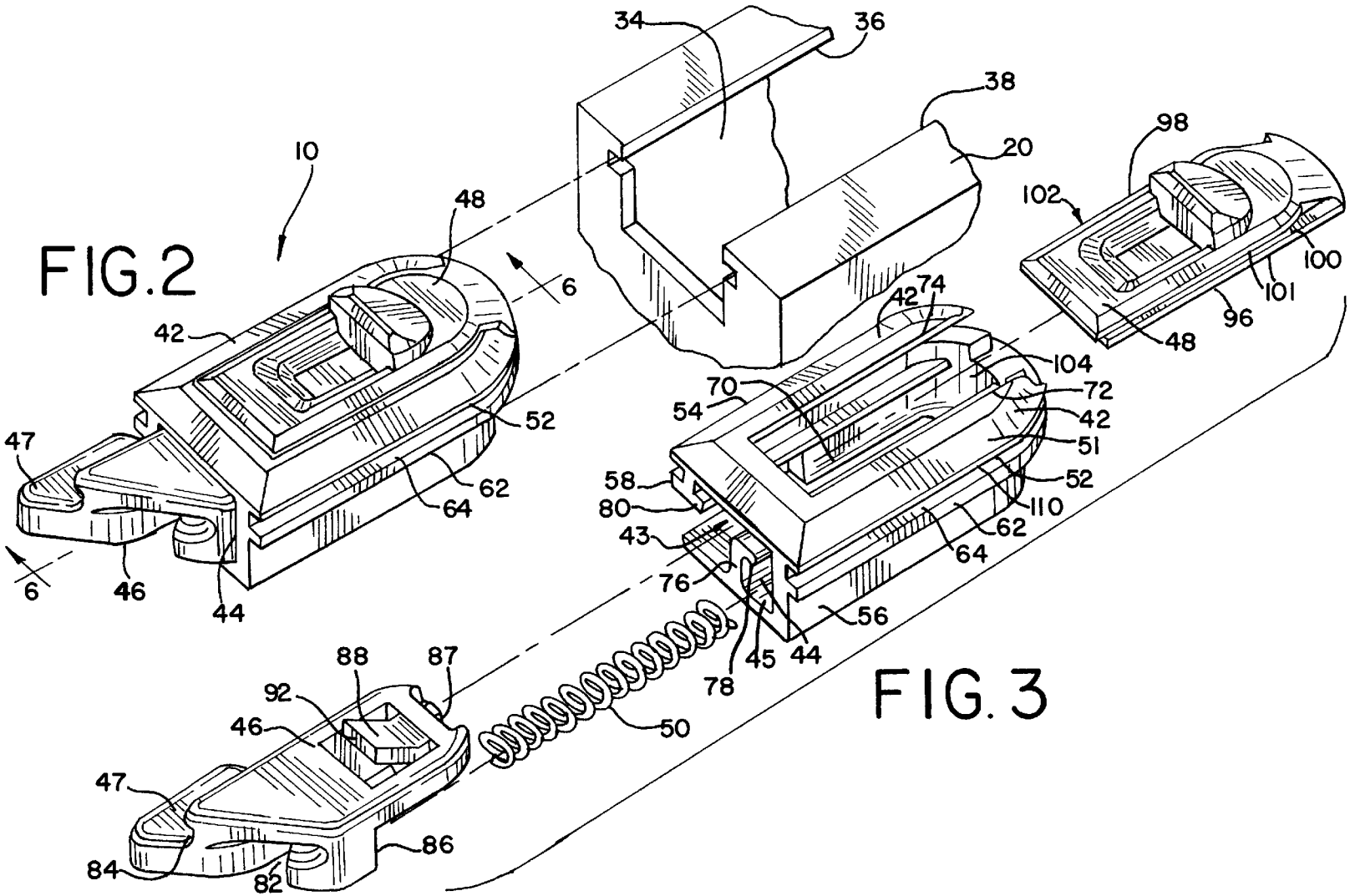
FIG. 2 is a perspective view of the tilt-latch of FIG. 1.
FIG. 3 is an exploded perspective view of the tilt-latch.

FIG. 1 shows a tilt-latch of the present invention, generally designated with the reference numeral 10, used in a sash window assembly 11. The sash window assembly 11 shown in FIG. 1 is a double-hung window assembly having a pivotal sash window 12 installed in a master frame 14. The tilt-latch 10 could also be used in other types of pivotal windows or structures. The sash window 12 is pivotally mounted to the master frame 14 by a pivot-corner/balance shoe assembly 15. As is well known, the master frame 14 has opposed, vertically extending guide rails 16. The sash window 12 has a hollow top sash rail 20, a base 22 and a pair of hollow stiles 24,26, cooperatively connected together at adjacent extremities thereof to form a sash frame, typically rectangular although other shapes are possible. The sash frame could be made from extrusions or pulltrusions that are filled with fiberglass, epoxy, plastic, or wood chips. The sash frame could also be solid and made from wood, masonite or pressboard. As shown in FIG. 2, the top sash rail 20 includes a pair of opposing header slots 34, which were formed as by routing the hollow top sash rail 20. Alternatively, the header slots 34 may be formed by prepunching the top sash rail 20. It is understood that the top sash rail 20, as well as the rest of the frame, could be solid. The top sash rail 20 could then be punch routed to accommodate the tilt-latch 10. Each of the header slots 34 forms a pair of opposing, longitudinal header rails 36,38. This is shown in greater detail in U.S. Pat. No. 5,139,291, which is expressly incorporated herein.

As shown in FIGS. 2–8, the tilt-latch 10 generally comprises a housing 42, a latch bolt 46, an actuator 48 and a spring 50. As shown in FIGS. 1–3, the housing 42 is adapted to be supported by the top rail 20. In a preferred embodiment, the housing 42 is designed to be flush-mounted in the top rail 20. It is understood, however, that the housing 42 could be designed to be supported in other ways by the top rail 20 such as a "top-mount" design. The latch bolt 46 is disposed within the housing 42. The actuator 48 is connected to the latch bolt 46 and is designed to retract the latch bolt 46 into the housing 42 against the biasing force of the spring 50. It is understood that the separate actuator 48 is not essential to the tilt-latch 10. The latch bolt 46 could alternatively be designed to be directly actuated. In the most preferred embodiment of the invention, however, the separate actuator 48 is utilized.

As shown in FIG. 3, in a most preferred embodiment, the housing 42 generally has a box-type structure defining a chamber 43 therein. The housing 42 has a cover 51 having opposing longitudinal edges 52,54. A pair of sidewalls 56,58 depend from the cover 51, and in the preferred embodiment are spaced inward of the respective longitudinal edges 52,54. The housing 42 further has a bottom wall 45. If desired, the tilt-latch 10 could be designed wherein the housing 42 has an open bottom end with no bottom wall. The cover 51, sidewalls 56,58 and bottom wall 45 cooperate to form the chamber 43 within the housing 42. The housing 42 also has an outward end opening 44 in communication with the chamber 43. The housing 42 is preferably of a one-piece construction. The one-piece construction strengthens the housing 42 and simplifies assembly. The housing 42, however, could also be made from multiple pieces. In addition, while a box-type housing structure is preferred, the housing could also take other forms. For example, the housing 42 could not include the bottom wall 45 but instead include tabs to hold the latch bolt 46 in the housing 42. The spring 50 could be held any number of ways as known in the art.

Figure 6:
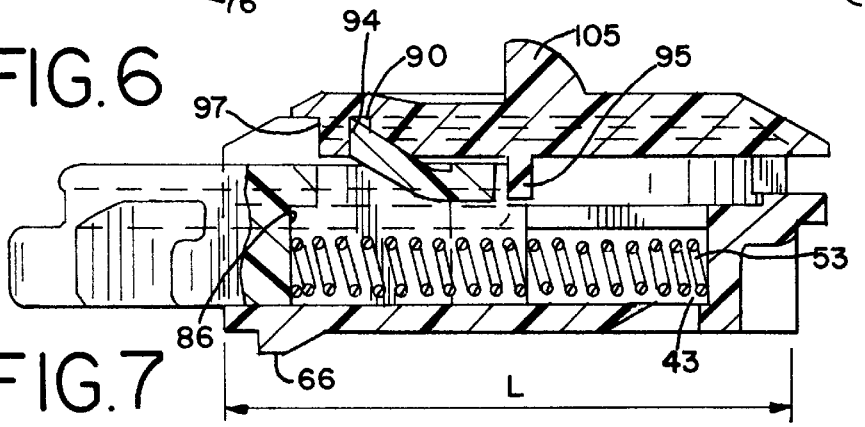
FIG. 6 is a cross-sectional view of the tilt-latch taken along Lines 6—6 of FIG. 2.
Figure 8:
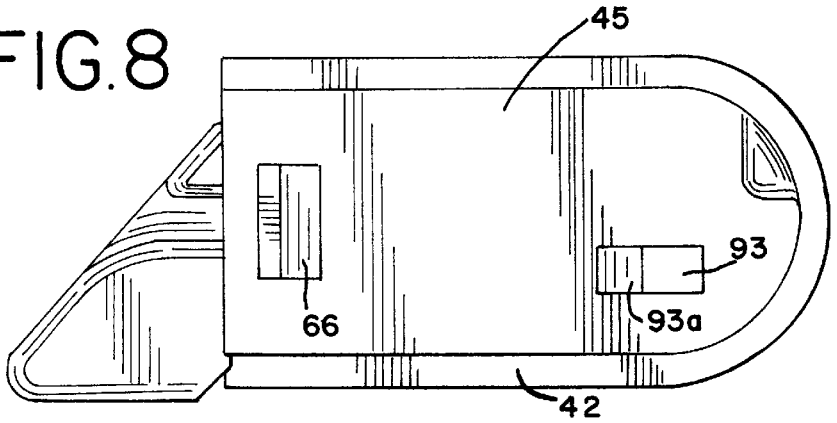
FIG. 8 is a bottom view of the tilt-latch.

Each of the sidewalls 56,58 has a sidewall rail 62 which cooperates with a respective one of the housing cover longitudinal edges 52,54, to form a longitudinal groove 64 adapted to cooperatively receive a respective one of the header rails 36,38. The sidewall rail 62 could be noncontinuous and comprise a number of spaced projections to form a noncontinuous groove with the cover 51. The housing cover longitudinal edges 52,54 could also be noncontinuous although this is normally not desired for cosmetic purposes. The sidewall rail 62 could also comprise one projection at a front portion of the sidewall and another projection on a rear portion of the sidewall to form the groove 64 with the cover 51. The sidewall rail 62 can also extend completely around the rear of the housing 42 to provide greater contact with the header rails 36,38. As shown in FIG. 6, the housing 42 could include a depending tab 66 for engaging an inner surface of a respective one of the stiles 24,26 when installed in the sash window frame. The depending tab 66 is preferably a solid, inflexible tab to maintain the structural rigidity of the housing 42. The depending tab 66, however, could also be flexible. The housing 42 could also have a screw hole for fastening to the top rail 20 such as if the sash frame was solid. As shown in FIG. 8, the bottom wall 45 of the housing 42 has a notched hole 93 therein to assist in the injection molding of the housing 42. While the hole 93 is not necessary, the notched hole 93 allows the mold pieces to overlap providing a better seal which will assist in controlling flash of the material of the housing 42. The hole 93 also has a ramp 93*a* that elevates one of the mold pieces above the inside wall of the housing 42. Also, the notched hole 93 could also be used as a screw hole to secure the tilt-latch 10 to the top rail 20, for example, when the top rail 20 is a solid structure.

As further shown in FIG. 3, the cover 51 of the housing 42 has an elongated opening 70. The elongated opening 70 defines a pair of rails 72,74. The housing 42 also has a first tongue 76 or guide extending from the housing 42 and into the chamber 43. In a preferred embodiment, the first tongue 76 is positioned along the bottom wall 45 of the housing 42 and is spaced from the sidewalls 56,58. In a most preferred embodiment, the tongue 76 is centered along the bottom wall 45. The first tongue 76 also preferably extends along an entire length of the bottom wall 45. Also preferably, the first tongue 76 is a continuous rail-like structure. The tongue 76, however, could comprise a discontinuous structure, for example, a plurality of spaced projections. Furthermore, it is understood that the first tongue 76 is not required to extend from the bottom wall 45. The tongue 76 can extend from other areas or walls of the housing 42 such as a sidewall of the housing 42. If the tongue 76 extended from a sidewall, the housing 42 may be dimensioned having a more narrow width and a greater height. The tongue 76 could also extend at different angles, or can take many different shapes. In addition, it is understood that the first tongue 76 is not required to extend along the entire length of the housing 42. The first tongue 76 further includes a flange 78 extending therefrom. Preferably, the flange 78 extends transversely from the first tongue 76. The flange 78 could extend in either transverse direction or other directions. The housing 42 also has a second tongue 80 that extends from one of the sidewalls 54 and into the chamber 43. Similar to the first tongue 76, the second tongue 80 can extend from other walls of the housing 42 or comprise a discontinuous structure. In addition, the second tongue 80 can comprise many different forms although it preferably comprises a rail-like structure.

Figure 4:
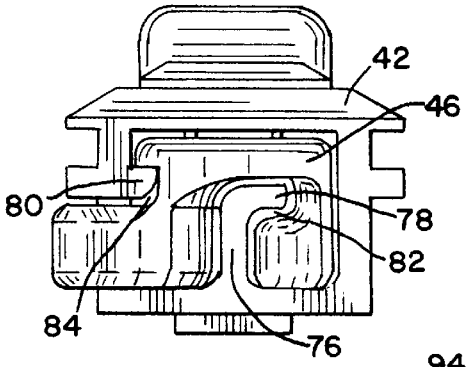
FIG. 4 is a front end view of the tilt-latch.
Figure 5:
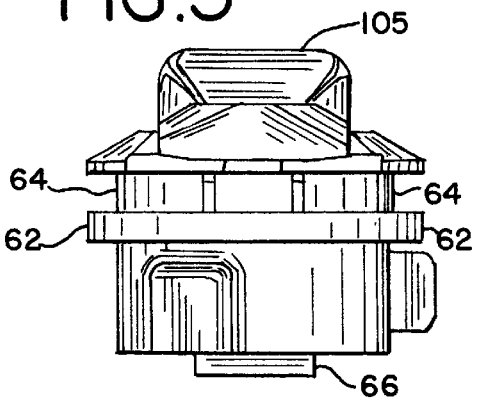
FIG. 5 is a rear end view of the tilt-latch.

As shown in FIGS. 2 and 3, the latch bolt 46 is disposed within the chamber 43 of the housing 42. The latch bolt 46 has a nose 47 adapted for engaging a respective one of the guide rails 16. As shown in FIGS. 3 and 4, the latch bolt 46 has a first bolt channel 82 and a second bolt channel 84. When the latch bolt 46 is disposed within the housing 42, the first bolt channel 82 is in cooperative sliding engagement with the first tongue 76. The first bolt channel 82 is also shaped to also be in cooperative sliding engagement with the flange 78 of the first tongue 76. Also, the second bolt channel 84 is in cooperative sliding engagement with the second tongue 80. While there is cooperative sliding engagement, it is not required that there be complete surface-to-surface engagement between the tongues and channels. The tongue and channel configuration guides the latch bolt 46 within the housing 42 and strengthens the overall structure of the tilt-latch 10. If the first tongue 76 is designed to not extend the full length of the housing 42, such as being set back into the chamber 43 of the housing 42, the latch bolt 46 could be closed at one end wherein the first bolt channel 82 would not extend through the entire length of the latch bolt 46. It is understood that the first bolt channel 82 and the second bolt channel 84 can comprise discontinuous structures. It is further understood that the tongue/channel configuration between the housing 42 and the latch bolt 46 could be reversed wherein the tongue extends from the latch bolt and the channel is positioned on the housing. It is also understood that additional tongue/channel configurations can be utilized.

Also shown in FIG. 3, the latch bolt 46 preferably has a spring wall 86 that is designed to engage or abut against one end of the spring 50. Alternatively, the spring wall could be hollowed out to form a pocket that receives one end of the spring 50. The spring 50 functions to bias the latch bolt 46 out of the housing 42. The spring wall 86 is positioned adjacent the first bolt channel 82. Preferably, as shown in FIG. 6, the spring 50 is positioned in the chamber 43 and has one end positioned abutting the spring wall 86 and another end abutting a rear wall 53 of the housing 42 wherein the latch bolt 46 is biased through the outward end opening 44 of the housing 42. As shown in FIGS. 3 and 6, the tongue 76 and the sidewall 56 form a passageway to accommodate the spring 50. In addition, the flange 78 extends over a top portion of the spring 50. The first tongue 76 and flange 78 provide a two-surface wrap around of the spring 50. The first tongue 76 and flange 78 cooperate with the housing 42 to partially encapsulate a length of the spring 50. Such configuration prevents the need for a post on the latch bolt 46 to support the spring 50 or a separate spring stop associated with the housing 42. The flange 78 extends far enough over the spring 50 to prevent the spring 50 from moving upwards in the housing 42. The flange 78 could also be angled downwards to provide a downward force on the spring 50. Other biasing members could also be used in place of the spring 50 which is a coil spring. For example, other types of springs can be used such as z-springs and leaf springs although coil springs are preferred. Rubber or polymeric resilient members could also be used. In addition, resilient plastic member(s) could be integrally attached to the latch bolt 46 to bias the latch bolt 46 out of the housing 42. In sum, any structure could be used that will cause the latch bolt 46 to move back and forth. It is further understood that a biasing means is not required. The tilt-latch could be adapted for manual retraction and extension of the latch bolt 46.

Finally, the latch bolt 46 has a post 88 (FIG. 3) extending from a top portion of the latch bolt 46. The post 88 is preferably resilient, although not required, and projects towards the beveled portion 47 of the latch bolt 46. The post 88 cooperates with the actuator 48 described in greater detail below. At a rear end portion of the latch bolt 46 is a bolt slot 87.

As further shown in FIG. 3, the actuator 48 is connected to the latch bolt 46. In a preferred embodiment, the actuator 48 is separate from the latch bolt 46 although it is understood that the latch bolt 46 and actuator 48 could be a single, integrally-molded piece. Also, one could actuate the latch bolt 46 without the separate actuator 48. After the latch bolt 46 is inserted into the housing 42 through the outward end opening 44, the post 88 resiliently deflects under the housing cover 51 and snaps into the actuator 48. As shown in FIG. 6, the actuator 48 has a notch 90 that receives the post 88 to connect the latch bolt 46 to the actuator 48. Specifically, the post 88 snaps into the notch 90 wherein a front surface 92 on the post 88 engages a facing surface 94 of the notch 90. It is understood that the post 88 on the latch bolt 46 and the notch 90 on the actuator 48 could be reversed. The actuator 48 also has a finger 95 extending downwardly into the bolt slot 87 of the latch bolt 46. In this configuration, the latch bolt 46 moves together with the actuator 48. A front portion 97 of the actuator 48 abuts the housing 42 to serve as a bolt stop for the latch bolt 46. Alternatively, the housing 42 could have a notch cut into the bottom wall 45 and the latch bolt 46 could have a hook that catches on the notch to serve as a bolt stop, similar to the tilt-latch disclosed in U.S. Pat. No. 5,139,291.

As shown in FIG. 3, on opposed longitudinal edges 96,98 of the actuator 48, a pair of rails 101 cooperate to form an actuator channel 100,102 on the opposed longitudinal edges 96,98. The actuator channels 100,102 cooperate with the elongated opening rails 72,74 of the housing 42 wherein the actuator 48 is slideable along the cover 51 to retract the latch bolt 46 into the chamber 43 of the housing 42. Again, it is understood that the channels 100,102 could be continuous or noncontinuous. As shown in FIG. 2, the actuator 48 completely covers the elongated opening 70 when the latch bolt 46 is biased through the outward end opening 44. A rear portion 103 of the actuator 48 is flush with the outer bounds of the housing 42. The actuator 48 also has a control button 105 integral therewith although it could be a separately mounted piece. An operator's finger engages the control button 105 and pulls back on the actuator 48. The actuator 48 slides along the cover 51 with the actuator channels 100,102 in sliding cooperative engagement with the elongated opening rails 72,74.

Figure 7:
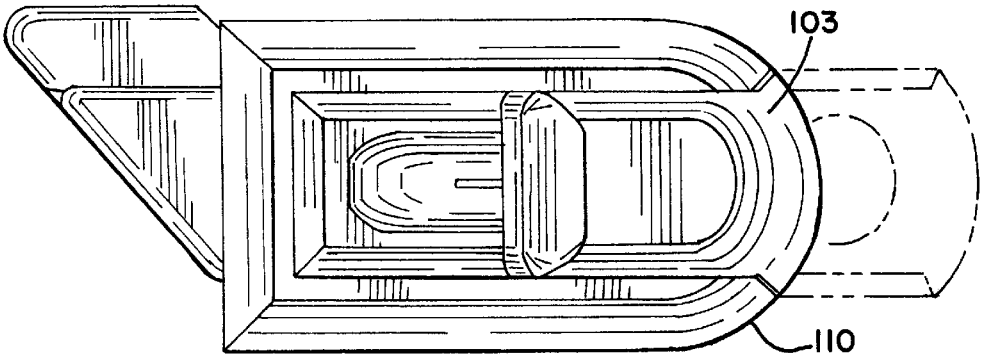
FIG. 7 is a plan view of the tilt-latch, an actuator being shown in phantom lines representing a retracted position.

As shown in FIG. 7, the housing has an outer edge 110 that typically is considered to extend around the outer periphery of the housing 42. The rear portion 103 of the actuator 48 moves past the housing 42 as the latch bolt 46 is retracted into the chamber 43 of the housing 42. The actuator 48 moves past the outer edge 110 when the latch bolt 46 is retracted into the housing 42. In a preferred embodiment, and as shown in FIG. 3, the housing 42 has a peripheral opening 104 in a rear portion of the housing 42. The peripheral opening 104 is in communication with the elongated opening 70. At the rear portion or one end of the housing 42, the outer edge 110 accommodates the peripheral opening 104. When the latch bolt 46 is in its normal, extended position biased out of the housing 42, the actuator 48 is positioned in the elongated opening 70. When the actuator 48 is actuated to retract the latch bolt 46 into the housing 42, the rear portion 103 of the actuator 48 extends beyond the outer edge 110 by extending through and past the peripheral opening 104 (FIG. 7). In addition, the actuator 48 is preferably positioned above the outer edge 110 of the housing 42. The actuator 48 is also adapted to be positioned above the top rail 20 wherein the actuator 48 slides along the top rail 20 when retracting the latch bolt 46 into the housing 42 (See FIG. 1). It is understood that the peripheral opening 104 could be eliminated but that the actuator 48 and housing 42 could still be configured such that the actuator 48 moves past the outer edge 110 when the latch bolt 46 is retracted. In a preferred embodiment, the latch bolt 46 and actuator 48 are connected together such that the actuator 48 moves past the outer edge 110 of the housing 42 a distance equal to a distance the latch bolt 46 is retracted into the housing 42. Because the actuator 48 can extend past the housing 42, the housing 42 can be dimensioned to a shorter length L (FIG. 6). The chamber 43 of the housing 42 is not required to accommodate the entire movement of the actuator 48. As previously stated, it is understood that the actuator 48 can be an integral part of the latch bolt 46. As such, the peripheral opening 104 could be enlarged wherein the actuator 48 and latch bolt 46 could extend past the outer edge 110 of the housing 42 when the latch bolt 46 is retracted into the housing 42. It is further understood that this latch bolt/actuator configuration could be utilized in a tilt-latch without the tongue and groove arrangement between the latch bolt 46 and the housing 42

Figure 11:
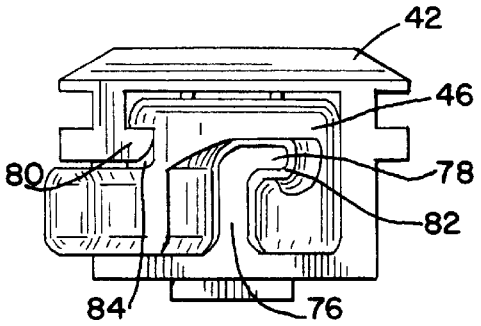
FIG. 11 is a front end view of the tilt-latch of FIG. 9.
Figure 12:
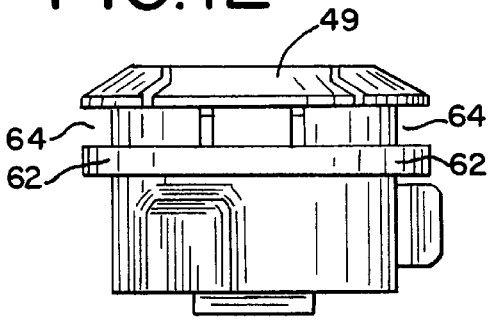
FIG. 12 is a rear end view of the tilt-latch of FIG. 9.
Figure 13:
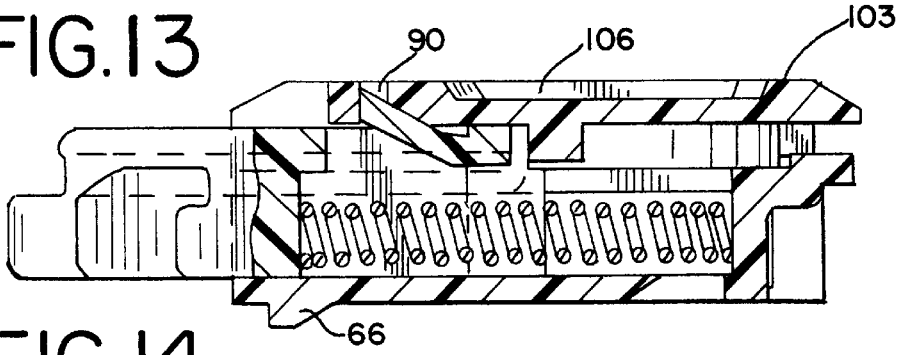
FIG. 13 is a cross-sectional view of the tilt-latch taken along Lines 13—13 of FIG. 9.
Figure 14:
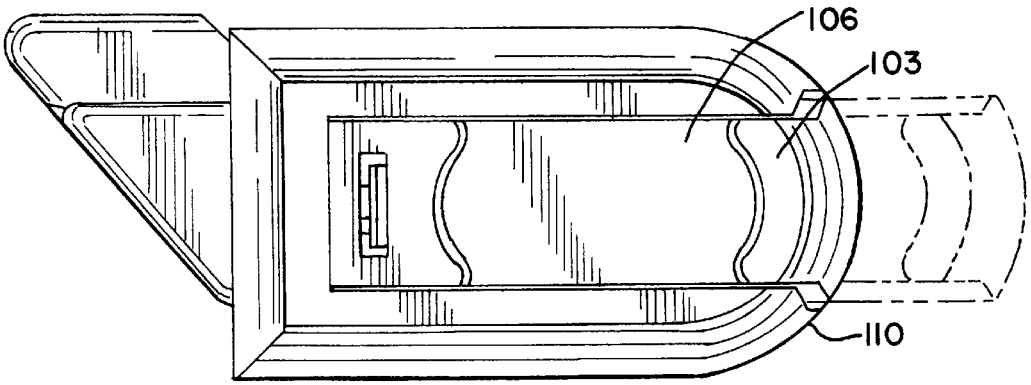
FIG. 14 is a plan view of the tilt-latch of FIG. 9, an actuator being shown in phantom lines, representing a retracted position.
Figure 15:
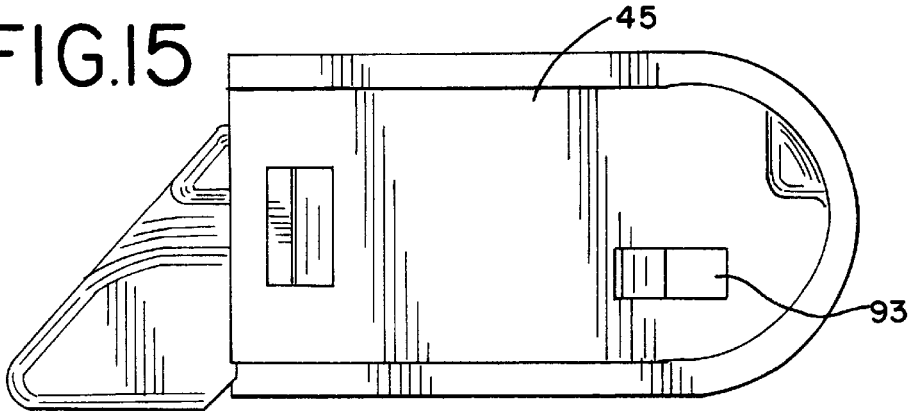
FIG. 15 is a bottom view of the tilt-latch of FIG. 9.

FIGS. 9–15 show another embodiment of the tilt-latch of the present invention, generally designated with the reference numeral 10*a*. Like the tilt-latch 10 of FIGS. 1–8, it generally comprises a housing 42, a latch bolt 46, a spring 50 and an actuator 49. Like parts are referred to with identical reference numerals. The actuator 49 of the tilt-latch 10*a* functions very similar to the actuator 48 of FIGS. 1–8. The actuator 49 has actuator channels 100*a*,102*a* that cooperate with the elongated opening rails 72,74. The actuator channels 100*a*,102*a* are not as defined as the actuator channels 100,102. The actuator 49 also has the notch 90 on its underside for receiving the post 88 of the latch bolt 46. In the tilt-latch 10*a*, however, the actuator 49 does not have a raised control button 105 as in the actuator 48 of FIGS. 1–8. The actuator 49 has a recessed portion 106 to accommodate an operator's finger tip and serve as a control button. This allows an operator's finger to frictionally engage the recessed portion 106 or engage a rear surface 107 on the actuator 49 to pull back on the actuator 49 and retract the latch bolt 46 into the housing 42. As shown in FIGS. 11–12, the actuator 49 sits flush with the housing 42. Furthermore, no portion of the actuator 49 extends past the outer bounds of the housing 42. Accordingly, the actuator 49 provides an even more streamlined tilt-latch as shown in FIGS. 11–13. As shown in FIG. 14, the actuator 49 extends past the outer edge 110 of the housing 42 when the latch bolt 46 is retracted into the housing 42. Specifically, the rear portion 103 of the tilt-latch 10*a* extends past and through the peripheral opening 104 when the latch bolt 46 is retracted into the housing 42.

Figures 9, 10, 16:
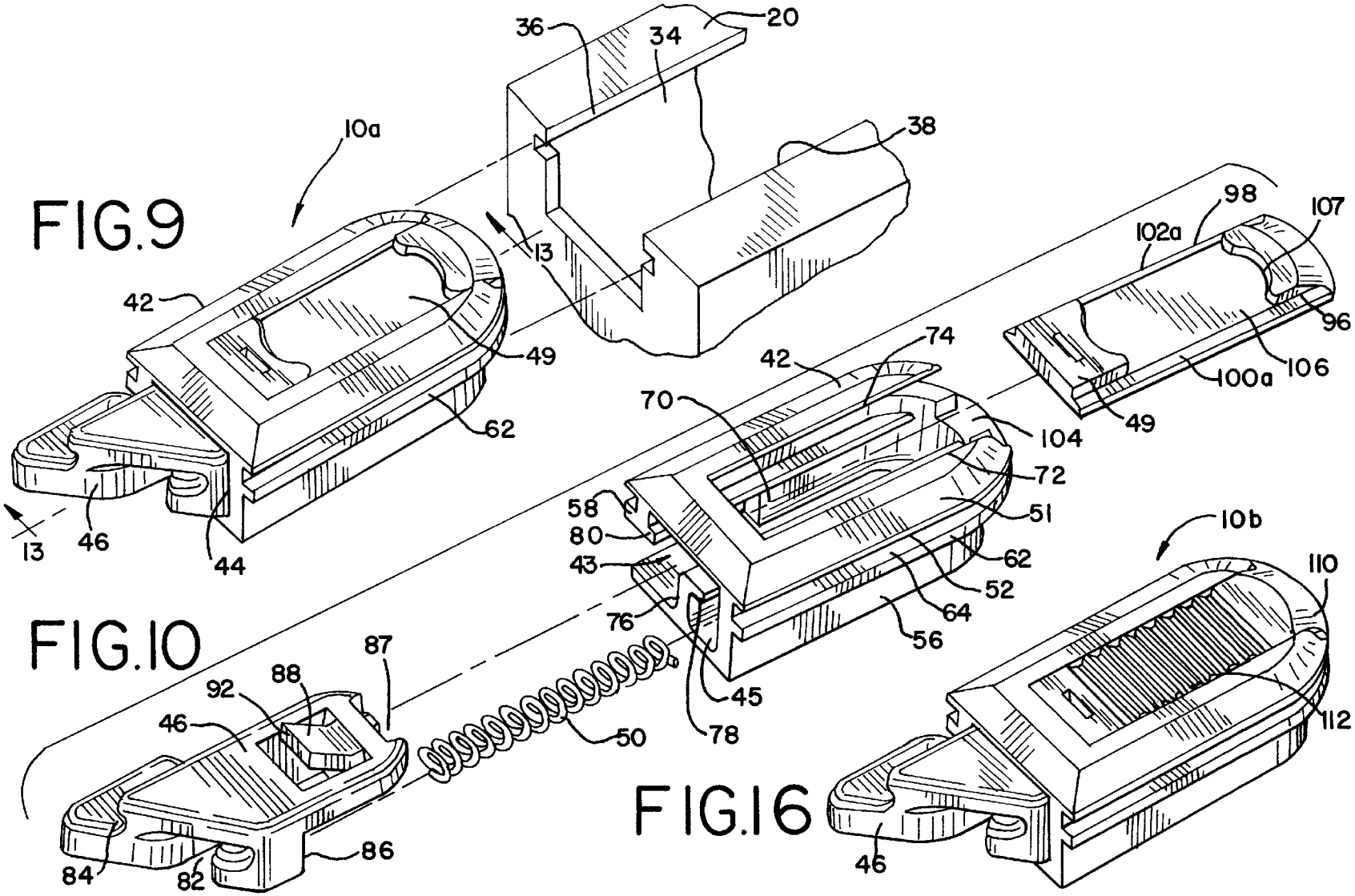
FIG. 9 is a perspective view of another embodiment of the tilt-latch of the present invention.
FIG. 10 is an exploded perspective view of the tilt-latch of FIG. 9.
FIG. 16 is a perspective view of another embodiment of the tilt-latch of the present invention

FIG. 16 shows another embodiment of the tilt-latch of the present invention, generally designated with the reference numeral 10*b*. The tilt-latch 10*b* has an actuator 110 having a plurality of ridges 112. The ridges 112 serve as a control button wherein an operator's finger can frictionally engage the ridges 112 and retract the actuator 110 and latch bolt 46.

The tilt-latch 10 is easily preassembled by first inserting one end of the spring 50 into housing 42 through the outward end opening 44. The latch bolt 46 is then inserted into the housing 42 through the outward end opening 44 (the first tongue 76 and flange 78 and second tongue 80 in cooperative sliding engagement with the first bolt channel 82 and second bolt channel 84 respectively). The actuator 48 is then slid onto the cover 51 (the actuator channels 100,102 in cooperative sliding engagement with the elongated opening rails 72,74) until the post 88 is received into the notch 90 on the actuator 48.

FIGS. 17–21 disclose another embodiment of the tilt-latch of the present invention, generally designated with the reference numeral 10*c*. As shown in FIG. 8E, the tilt-latch 10*c* generally comprises a housing 120, a latch bolt 122 and a spring 50. The structure of the housing 120 is similar to the structure of the housing 42 and similar elements will be designated with identical reference numerals.

Figures 17, 18:
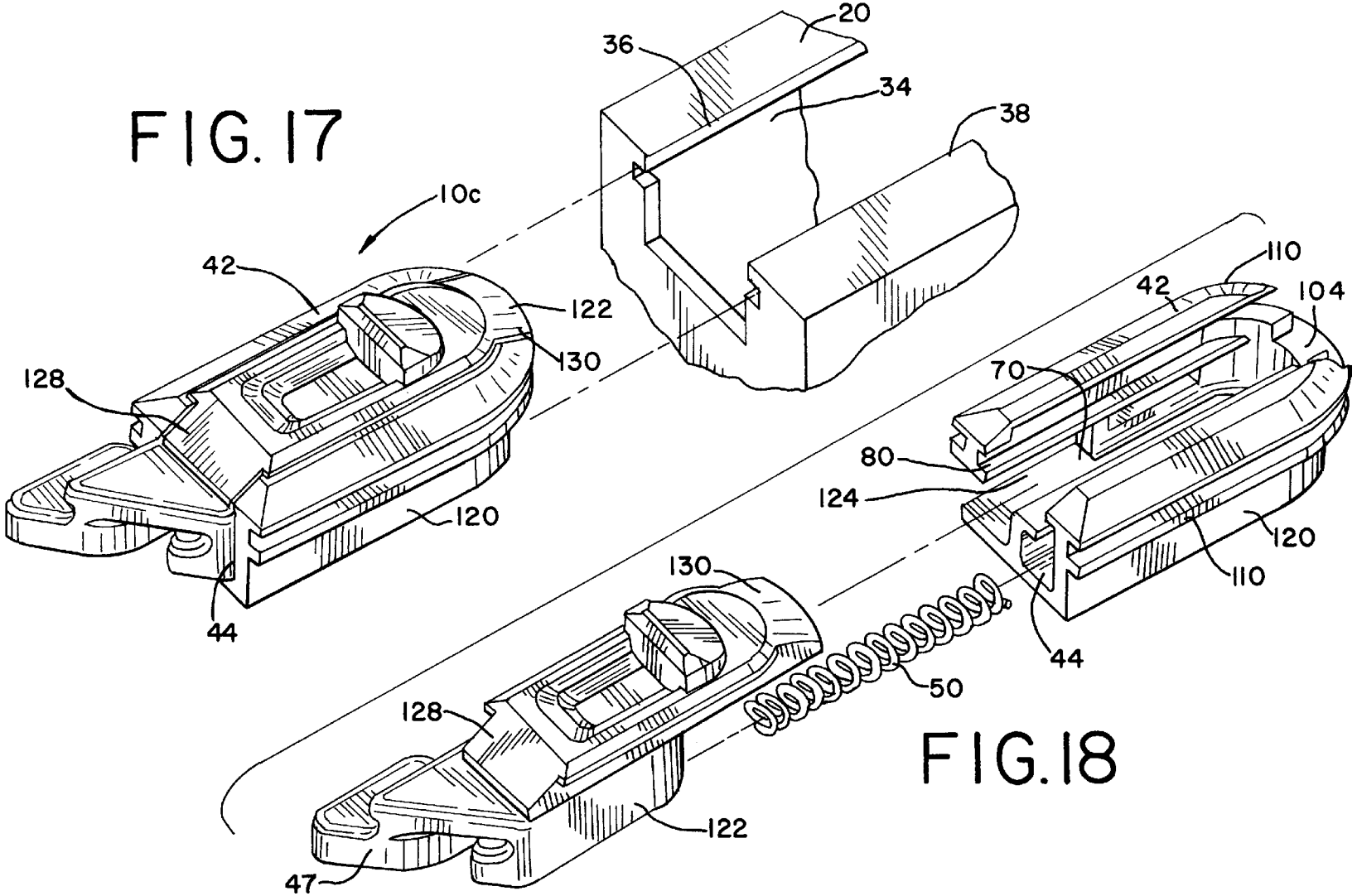
FIG. 17 is a perspective view of another embodiment of the tilt-latch of the present invention.
FIG. 18 is an exploded perspective view of the tilt-latch of FIG. 17.
Figure 19:
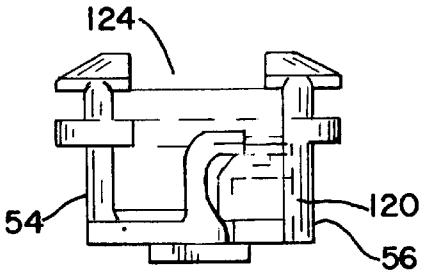
FIG. 19 is a front end view of a housing of the tilt-latch of FIG. 17.
Figure 20:
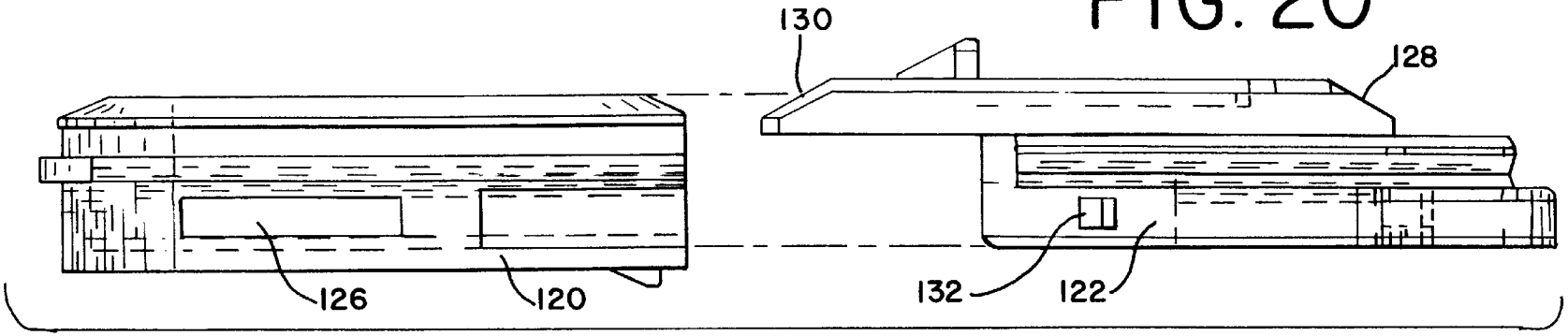
FIG. 20 is an exploded side elevational view of the housing and a latch bolt of the tilt-latch of FIG. 17.
Figure 21:
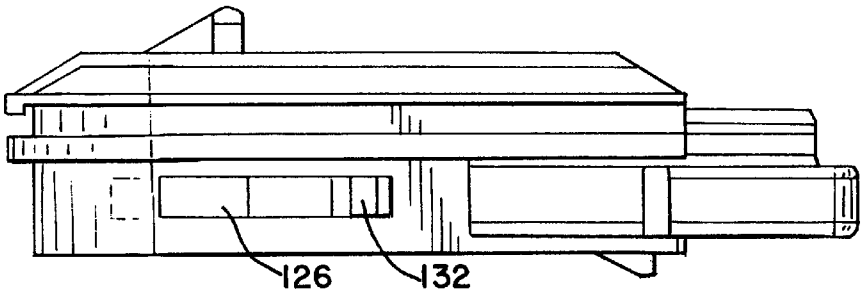
FIG. 21 is a side elevational view of the tilt-latch of FIG. 17.

The housing 120 is adapted to be supported by the top rail 20. The housing 120 has the outward end opening 44 and the outer edge 110. As shown in FIGS. 18 and 19, the housing 120 also has a notch 124 at a front end of the housing 120. The notch 124 is in communication with the outward end opening 44 and the elongated opening 70. The outer edge 110 accommodates the peripheral opening 104.. As shown in FIGS. 20 and 21, the housing further has a slot 126 on one of the sidewalls 54,56 of the housing 120. For tooling considerations, the slot 126 could be extended as shown by the phantom lines. This would allow the mold pieces to be directly retracted apart rather than requiring a tertiary mechanism to move the mold pieces before they are retracted. The housing 120 also has other structure of the housing 42 as previously discussed. This housing 120 is less rigid than the housings 42 of FIGS. 1–16 since additional material has been removed to accommodate the notch 124 and the slot 126. The top rail 20, however, assists in the overall rigidity of the installed tilt-latch 10*c*. If desired, the housing 120 could be made of different materials having increased rigidity. The housing 120 could also have a wider cross-section, possess thicker walls or incorporate ribbing to increase its rigidity.

The structure of the latch bolt 122 is similar to the structures of the latch bolt 46 and actuator 48. As shown in FIGS. 18 and 20, however, the latch bolt 122, has an integral structure to engage one of the guide rails 16 of the master frame 14 and to actuate the latch bolt 122 thereby retracting the latch bolt 122 into the housing 120. The latch bolt 122 is supported within the housing 120 and has the nose 47 adapted for engaging a respective one of the guide rails 16. As shown in FIGS. 17 and 18, the latch bolt 122 has a frontal segment 128 and a rear portion 130. As shown in FIG. 20, the latch bolt 122 also has a protrusion 132 extending from one of its sides. The protrusion 132 could also extend from other areas of the latch bolt 122 such as from a bottom side, therefore adapted to protrude through a corresponding slot on a bottom wall of the housing 120.

FIGS. 17 and 21 show the assembled tilt-latch 10*c*. To assemble the tilt-latch 10*c*, the spring 50 is inserted into the housing 120. The latch bolt 122 is then inserted into the housing 120 through the notch 124. The sidewall of the housing 120 having the slot 126 deflects sufficiently to allow the protrusion 132 on the latch bolt 122 to be received in the slot 126. The tilt-latch 10*c* could also be designed wherein the latch bolt 122 could be inserted from the rear of the housing 120. The latch bolt 122 is supported within the housing 120 wherein the nose 47 extends through the outward end opening 44. The frontal segment 128 is received in the notch 124 of the housing 120. The rear portion 130 is flush within the outer edge 110 of the housing 120. Also, the protrusion 132 is received in the slot 126 of the housing 120. The slot/protrusion configuration serves as a stop to prevent the latch bolt from being biased completely out of the housing 120 by the spring 50. It is understood that the slot/protrusion configuration could be included on the other side of the tilt-latch 10*c*. It is further understood that the slot/protrusion configuration could be positioned on other areas of the tilt-latch 10*c* such as on a bottom side of the tilt-latch. It is also understood that the bottom wall of the housing 120 could be eliminated wherein the slot/protrusion configuration could be used to retain the latch bolt 122 within the housing 120. In such a case, the tongue/groove configurations could be moved to other portions of the housing 120 and latch bolt 122. When the latch bolt 122 is retracted into the housing 120, the rear portion 130 of the latch bolt 122 moves past the outer edge 110 of the housing 120. Specifically, the outer edge 110 accommodates the peripheral opening 104 wherein the latch bolt 122 moves past the outer edge 104 by passing through the peripheral opening 110 when the latch bolt 122 is retracted into the housing 120.

Figure 22:
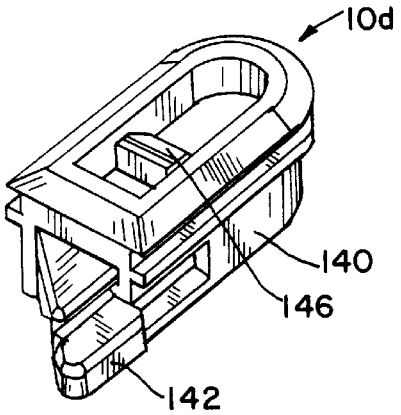
FIG. 22 is a perspective view of another embodiment of the tilt-latch of the present invention.
Figure 23:
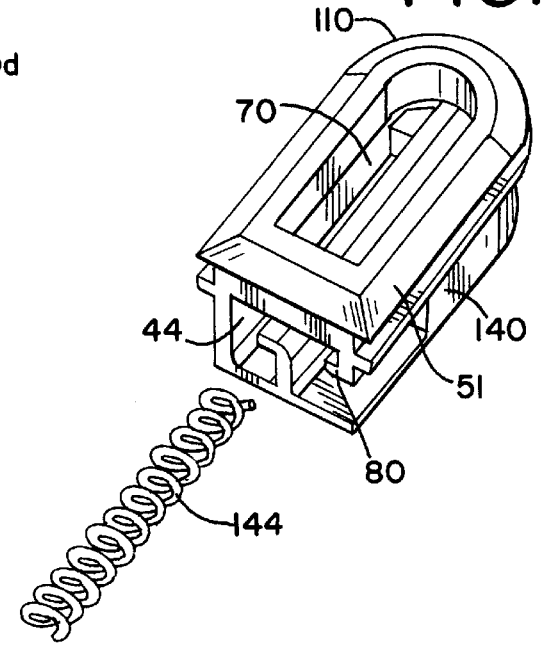
FIG. 23 is an exploded perspective view of the tilt-latch of FIG. 22.
Figure 23:
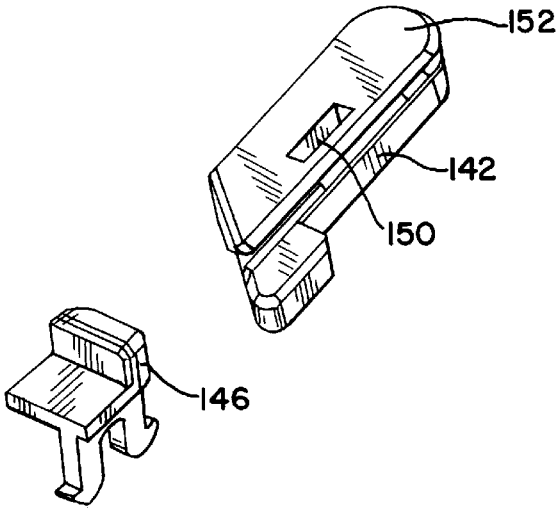

FIGS. 22–25 disclose another embodiment of the tilt-latch of the present invention, generally referred to with the reference numeral 10*d*. As shown in FIG. 23, the tilt-latch 10*d* generally comprises a housing 140, a latch bolt 142, a spring 144 and a control button 146. The structure of the elements of the tilt-latch 10*d* are similar to the elements of the previous tilt-latches and similar elements of the tilt-latch 10*d* will be designated with identical reference numerals.

Figure 24:
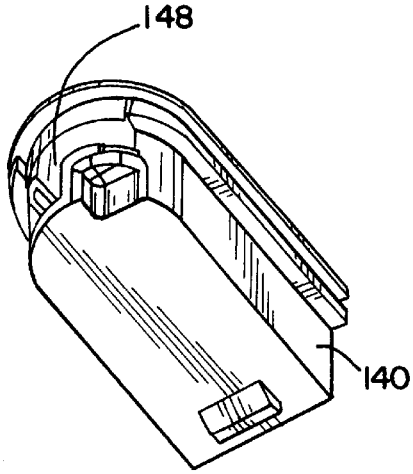
FIG. 24 is rear perspective view of the housing of the tilt-latch of FIG. 22 showing a second end opening.
Figure 25:
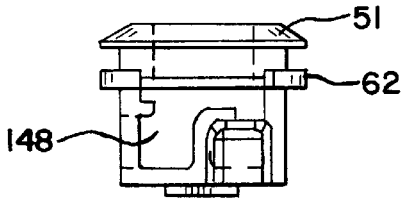
FIG. 25 is an end elevational view of the tilt-latch of FIG. 22 showing the second end opening.

As shown in FIGS. 22 and 23, the housing 140 has the outward end opening 44 as well as the elongated opening 70 and outer edge 110. As shown in FIGS. 24 and 25, the housing 140 further includes a has a second outward end opening 148 that is preferably positioned opposite the outward end opening 44 although it could be positioned at other areas of the housing 140. The second outward end opening 148 is also preferably positioned below the cover 51 of the housing 140. This allows the cover 51 to have a solid outer periphery without the need to accommodate a peripheral opening, such as the peripheral opening 104 shown in other embodiments. This typically also requires a slight increase in the height of the housing 140 as compared to the housing 42. Also, as shown in FIGS. 24 and 25, the sidewall rail 62 has a portion removed to accommodate the second outward end opening 148. The second outward opening 148 is shaped to accommodate the latch bolt 142. The control button 146 is attached to the latch bolt 142 by snapping the control button 146 into a slot 150 on the latch bolt 142. The control button 146 is positioned in the elongated opening 70. As shown in FIG. 22, because the increased height of the housing 140 and the position of the second outward end opening 148, the elongated opening 70 is deeper.

When the latch bolt 142 is retracted into the housing 140 by depressing the control button 146, a rear portion 152 of the latch bolt moves past the outer edge 110 of the housing 140 by passing through the second outward end opening 148. Preferably, the portion 152 passes underneath a planar member 21 (FIG. 1) of the top rail 20. An extruded top rail 20 will typically be hollow and can accommodate the latch bolt 142. Solid top rails would have to be modified. It is understood that the thickness of the planar member 21 of the top rail 20 can vary. Similar to the previous embodiments, the control button 146 is movable between a substantially front of the elongated opening (FIG. 22) to a substantially rear of the elongated opening when the latch bolt 142 is retracted into the housing 140. By allowing the portion 152 of the latch bolt 142 to pass through the second outward end opening 148, the length of the housing 140 is minimized.

It is understood that the tilt-latches 10–10*d* of the present invention embody many different features, and any combination of the features could be utilized to form tilt-latches of the present invention.

In another variation of any of the tilt-latches 10–10*d* of the present invention, the tilt-latch includes the housing 42 and the latch bolt 46 (as well as the housing and latch bolts of the other embodiments). The housing 42 has the length L (See e.g., FIG. 7) and the elongated opening 70 (FIGS. 3,18,22). In a preferred embodiment, the elongated opening 70 extends substantially the entire length of the housing 42. An outer portion of the cover 51 of the housing 42 defines the outer edge 110 of the housing 42 and extends around the elongated opening 70. As shown in FIG. 6, the latch bolt 46 has the nose 47 extending through the outward end opening 44 and another portion extending into the housing 42. Space is maintained between the latch bolt 46 and the rear wall 53 of the housing 42 to accommodate retraction of the latch bolt 46 into the housing 42. Rather than having the separate actuator 48, the latch bolt 46 can have a control button similar to the control button 105,146 wherein the control button is connected to the portion of the latch bolt 46 extending into the housing 42. The control button can extend into the elongated opening 70. To actuate the latch bolt 46, the control button is movable between a substantially front of the elongated opening 70 to a substantially rear of the elongated opening 70 when the latch bolt 46 is retracted into the housing 42. The control button can engage a front section of the housing when the latch bolt 46 is biased through the outward end opening 44 to serve as a stop if desired. Because the elongated opening 70 extends substantially the entire length of the housing 42, the opening 70 can accommodate the required displacement of the control button in order to retract the latch bolt 46 completely. Accordingly, the length of the housing 42 can be minimized. There is not considerable lengths of the housing 42 that extend from each end of the elongated openings such as in prior art tilt-latches. In such configuration, the length of the housings can be minimized while no portions of the latch bolts or actuators move past the outer edges of the housing. In another example, the tilt-latch 10*c* can have a latch bolt 122 having a shorter rear portion 130 (FIG. 18) and, for example, having the control button portion moved forward on the latch bolt. In such a configuration, the control button portion is movable between a substantially front of the elongated opening 70 to a substantially rear of the elongated opening 70 when the latch bolt 122 is retracted into the housing 120. By having a shorter rear portion 130, the housing 120 can accommodate the entire displacement of the latch bolt into the housing 120. Similarly, in the tilt-latch 10*d* (FIGS. 22–25), the latch bolt 142 could be shortened wherein the second outward opening 148 would not be necessary. By shortening a rear portion of the latch bolt 142 (the spring 144 may also be modified accordingly), the housing 140 can accommodate the entire displacement of the latch bolt 142 when the control button 146 moves from substantially a front portion of the elongated opening 70 (FIG. 22) to a substantially rear portion of the elongated opening 70 when the latch bolt 142 is retracted into the housing 140. Accordingly, the second outward end opening 148 could be eliminated.

After preassembly, the tilt-latch 10–10*d* can then be installed into the sash window 12. Preferably, the tilt-latch 10–10*d* is inserted from the side into a respective one of the header slots 34, such that the pair of longitudinal grooves 64 cooperatively receive a respective pair of the header rails 36,38. The tilt-latch 10–10*d* is inserted until the depending tab 66 has engaged the inner surface of a respective one of the stiles 24,26. Alternatively, the longitudinal groove could be formed with resilient tabs/projections wherein the tilt-latch 10–10*d* could be installed by snapping the latch in from the top of the top rail 20. In addition, the entire side wall rail 62 could be beveled to allow snap insertion from the top of the top rail 20. Regardless of the specific method of insertion into the top rail 20, once installed, the longitudinal grooves 64 cooperatively receive the header rails 36,38 and support the tilt-latch in the top rail 20.

The design and structure of the tilt-latch 10–10*d* of the present invention provide a number of advantages. Because the actuator or latch bolt can extend past the outer edges or bounds of the housing, the housing can have a shorter length L. Typically, the housing of a tilt-latch will accommodate the entire displacement of the latch bolt and actuator. This typically requires an elongated housing. For example, the commercial embodiment of the tilt-latch disclosed in U.S. Pat. No. 5,139,291 is approximately three inches. In one preferred embodiment of the present invention, the housing of the tilt-latch 10–10*d* is approximately 1¼ inches in length. Also in a preferred embodiment, the latch bolt extends from the housing approximately 7/16 of an inch and the displacement of the latch bolt is also approximately 7/16 of an inch. The latch bolt could be designed for other extensions such as ¼ inch. The tilt-latch 10–10*d* could be made different lengths if desired. For example, by changing the bolt displacement or biasing means, an even shorter tilt-latch 10–10*d* less than an inch long could be formed. A shorter, smaller, "stubbier" tilt-latch 10–10*d* of the present invention fundamentally makes a stronger tilt-latch. Furthermore, because the tilt-latch 10–10*d* is shorter, a smaller header slot 34 is required, and thus, less material is required to be removed from the top rail 20. This improves the structural integrity of the top rail 20 making it more rigid. A shorter latch also provides less of a moment and with respect to reactive forces of the tilt-latch reacting against, for example, wind forces exerted on the sash window 12.

Because of the minute structure of the tilt-latch 10–10*d* the individual components of the tilt-latch 10–10*d* such as the housing and the latch bolt must be connected with sufficient strength to withstand forces applied to the window sash 12. The cooperating structures, e.g. the first tongue 76, flange 78 and the first bolt channel 82; the second tongue 80 and the second bolt channel 84 strengthen the tilt-latch 10–10*d*. These cooperating structures also prevent the latch bolt from twisting within the housing. This increases the torsional resistance of the latch bolt within the housing to prevent an overload condition on the sash window.

In addition, in a typical double-hung window assembly, the lower window sash is wider than the top window sash. Because the tilt-latch 10–10*d* is short, the frame of the top window sash will extend past the tilt-latch 10–10*d*. This assists for security purposes since one could not determine the type of tilt-latch being used, if any, simply by looking through the sash window from the outside. The frame of the top window sash blocks the view of the tilt-latch 10–10*d*. In addition, because of the small size of the tilt-latch, drapes, blinds or other window coverings hide the tilt-latch improving the overall aesthetic appearance of the sash window assembly. Furthermore, because the tilt-latch 10–10*d* can be made smaller than typically sized flush tilt-latches, less material is used saving in material costs.

While the specific embodiments have been illustrated and described, numerous modifications come to mind without significantly departing from the spirit of the invention and the scope of protection is only limited by the scope of the accompanying Claims.

I claim:

1. A tilt-latch for a sash window disposed within opposed guide rails on a master frame, the sash window comprises a top rail, a base and two stiles connected together at their extremities, the top rail adapted to have opposed header slots, the tilt-latch adapted for releaseably securing the sash window to the master frame, the tilt-latch comprising:

housing rail having a means for supporting the housing in a respective one of the header slots, the housing having an outward end opening, the housing having a tongue, the tongue extending along a bottom wall of the housing and spaced from sidewalls of the housing; and, a latch bolt disposed within the housing and having a nose adapted for engaging a respective one of the guide rails, the latch bolt having a channel that receives the tongue.

2. The tilt-latch of claim 1 further comprising means for biasing the latch bolt through the outward end opening.

3. The tilt-latch of claim 2 wherein the biasing means comprises a spring.

4. The tilt-latch of claim 3 wherein the latch bolt has a wall and the spring has one end positioned abutting the wall and another end abutting the housing.

5. The tilt-latch of claim 3 wherein the tongue has a flange extending transversely from the tongue, the tongue and flange partially encapsulating a length of the spring.

6. The tilt-latch of claim 1 further comprising an actuator connected to the latch bolt.

7. The tilt-latch of claim 1 wherein the tongue extends substantially along the entire length of the bottom wall of the housing.

8. The tilt-latch of claim 1 wherein the tongue has a flange extending transversely from the tongue.

9. The tilt-latch of claim 8 wherein the latch bolt channel is in cooperative sliding engagement with the tongue and the flange.

10. The tilt-latch of claim 1 wherein the housing has a plurality of walls and the tongue extends from one of the walls.

11. The tilt-latch of claim 1 wherein the tongue has a flange extending transversely from the tongue.

12. The tilt-latch of claim 1 wherein the tongue comprises a continuous rail.

13. The tilt-latch of claim 1 wherein the tongue comprises a discontinuous rail.

14. The tilt-latch of claim 1 wherein the housing further includes a second tongue extending from a sidewall of the housing.

15. The tilt-latch of claim 1 wherein the housing has a plurality of walls and further includes a second tongue extending from one of the walls.

16. The tilt-latch of claim 14 wherein the latch bolt has a second channel in cooperative sliding engagement with the second tongue.

17. The tilt-latch of claim 1 wherein the housing further includes a cover and a pair of sidewalls depending from the cover, the cover having an elongated opening defining a pair of rails.

18. The tilt-latch of claim 17 wherein the actuator has an actuator channel on opposed edges of the actuator that cooperate with the elongated opening rails wherein the actuator is slideable along the cover.

19. The tilt-latch of claim 1 further comprising an actuator having a notch, wherein the latch bolt has a post, the post being received in the notch to connect the actuator to the latch bolt.

20. The tilt-latch of claim 1 wherein each header slot is adapted to have a pair of header rails and the housing has sidewalls wherein the means for supporting comprises a longitudinal groove on each sidewall, the longitudinal groove is adapted to receive the header rail to support the housing in the top rail.

21. The tilt-latch of claim 1 wherein the housing further includes a depending tab is adapted to engage one of the stiles.

22. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening, the housing further having an elongated opening in communication with a peripheral opening;

a latch bolt disposed within the housing and having a nose adapted for engaging a respective one of the guide rails; and, an actuator connected to the latch bolt and slideable along the housing wherein a rear portion of the actuator slides through the peripheral opening when the latch bolt is retracted into the housing.

23. The tilt-latch of claim 22 further comprising means for biasing the latch bolt through the outward end opening.

24. The tilt-latch of claim 22 wherein the housing has a cover defining the elongated opening, the elongated opening defining a pair of rails; the actuator having an actuator channel on opposed edges that cooperate with the elongated opening rails.

25. The tilt-latch of claim 22 wherein the latch bolt has a post and the actuator has a notch, the post received in the notch to connect the actuator to the latch bolt.

26. The tilt-latch of claim 22 wherein the actuator has a control button comprising a protrusion extending from the actuator.

27. The tilt-latch of claim 22 wherein the actuator has a control button comprising a recessed portion.

28. The tilt-latch of claim 22 wherein the actuator has a control button comprising a plurality of ridges.

29. The tilt-latch of claim 22 wherein the housing has a first tongue extending along a bottom wall of the housing and spaced from sidewalls of the housing.

30. The tilt-latch of claim 29 wherein the tongue has a flange extending therefrom, the latch bolt having a first bolt channel in cooperative sliding engagement with the first tongue and flange.

31. The tilt-latch of claim 22 wherein the housing has a second tongue extending from a sidewall and the latch bolt has a second bolt channel in cooperative sliding engagement with the second tongue.

32. The tilt-latch of claim 22 wherein the latch bolt has a wall and the biasing means is a spring, the spring having one end positioned abutting the wall and another end abutting the housing wherein the latch bolt is biased through the outward end opening.

33. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and an outer edge;

a latch bolt disposed within the housing and having a nose adapted for engaging a respective one of the guide rails; and, an actuator connected to the latch bolt wherein a portion of the actuator moves past the outer edge of the housing when retracting the latch bolt into the housing.

34. The tilt-latch of claim 33 further comprising means for biasing the latch bolt through the outward end opening.

35. The tilt-latch of claim 33 wherein the outer edge accommodates a peripheral opening wherein the actuator moves past the outer edge by passing through the peripheral opening when retracting the latch bolt into the housing.

36. The tilt-latch of claim 33 wherein the actuator is positioned above the outer edge of the housing.

37. The tilt-latch of claim 33 wherein the actuator is positioned flush with the outer edge of the housing.

38. The tilt-latch of claim 33 wherein the actuator is positioned below the outer edge of the housing.

39. The tilt-latch of claim 33 wherein the actuator is adapted to be positioned above the top rail.

40. The tilt-latch of claim 33 wherein the actuator moves past the outer edge of the housing a distance equal to a distance the latch bolt is retracted into the housing.

41. The tilt-latch of claim 33 wherein the housing has a cover defining the elongated opening, the elongated opening defining a pair of rails; the actuator having an actuator channel on opposed edges that cooperate with the elongated opening rails.

42. The tilt-latch of claim 33 wherein the latch bolt has a post and the actuator has a notch, the post received in the notch to connect the actuator to the latch bolt.

43. The tilt-latch of claim 33 wherein the housing has a tongue extending along a bottom wall of the housing and spaced from sidewalls of the housing.

44. The tilt-latch of claim 43 wherein the tongue has a flange extending therefrom, the latch bolt having a first bolt channel in cooperative sliding engagement with the tongue and flange.

45. The tilt-latch of claim 33 wherein the housing has a second tongue extending from a sidewall and the latch bolt has a second bolt channel in cooperative sliding engagement with the second tongue.

46. The tilt-latch of claim 33 wherein the latch bolt has a wall and the biasing means is a spring, the spring having one end positioned abutting the wall and another end abutting the housing wherein the latch bolt is biased through the outward end opening.

47. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted for substantially flush installation in the top rail, the housing having an outward end opening and an outer edge, the outer edge accommodating a peripheral opening;

a latch bolt supported within the housing and having a nose adapted for engaging a respective one of the guide rails, wherein a portion of the latch bolt moves past the outer edge of the housing by passing through the peripheral opening when the latch bolt is retracted into the housing.

48. The tilt-latch of claim 47 further comprising means for biasing the latch bolt through the outward end opening.

49. The tilt-latch of claim 47 wherein the latch bolt has an actuator to retract the latch bolt into the housing.

50. The tilt-latch of claim 47 wherein the housing has a notch, the notch being in communication with the outward end opening.

51. The tilt-latch of claim 50 wherein the latch bolt has a frontal segment that is received by the notch when the nose of the latch bolt extends from the outward end opening of the housing.

52. The tilt-latch of claim 47 wherein the housing has a slot and the latch bolt has a protrusion, the protrusion received by the slot.

53. The tilt-latch of claim 47 wherein the housing has a tongue extending from the housing and the latch bolt has a bolt channel in cooperative sliding engagement with the tongue.

54. The tilt-latch of claim 47 wherein the housing has a second outward end opening wherein the latch bolt moves past the outer edge of the housing by having a portion of the latch bolt pass through the second outward end opening.

55. The tilt-latch of claim 54 wherein the portion of the latch bolt passing through the second outward end opening passes underneath a planar member of the top rail.

56. The tilt-latch of claim 54 wherein the second outward end opening is positioned opposite the outward end opening.

57. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and a second outward end opening;

a latch bolt supported within the housing and having a nose adapted for engaging a respective one of the guide rails, wherein a portion of the latch bolt passes through the second outward end opening when the latch bolt is retracted into the housing.

58. The tilt-latch of claim 57 wherein the second outward end opening is positioned opposite the outward end opening.

59. The tilt-latch of claim 57 wherein the housing has a cover and the second outward end opening is positioned below the cover.

60. The tilt-latch of claim 57 wherein the portion of the latch bolt passes through the second outward end opening and underneath a planar member of the top rail.

61. The tilt-latch of claim 57 further comprising a control button connected to the latch bolt.

62. The tilt-latch of claim 61 wherein the housing has an elongated opening wherein control button is movable between a substantially front of the elongated opening to a substantially rear of the elongated opening when the latch bolt is retracted into the housing.

63. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail the housing having a cover, a bottom wall and a pair of sidewalls cooperatively defining a chamber, the chamber in communication with an outward end opening, a tongue extending from the housing into the chamber, the tongue extending substantially along the entire length of the bottom wall of the housing and being spaced from the sidewalls of the housing and, a latch bolt disposed within the chamber and having a nose adapted for engaging a respective one of the guide rails, the latch bolt having a channel in cooperative sliding engagement with the tongue.

64. The tilt-latch of claim 63 further comprising means for biasing the latch bolt through the outward end opening.

65. The tilt-latch of claim 63 further comprising an actuator connected to the latch bolt.

66. The tilt-latch of claim 63 wherein the tongue has a flange extending transversely from the tongue.

67. The tilt-latch of claim 66 wherein the latch bolt channel is in cooperative sliding engagement with the tongue and the flange.

68. The tilt-latch of claim 63 wherein the tongue has a flange extending transversely from the tongue.

69. The tilt-latch of claim 63 wherein the housing further includes a second tongue extending from a sidewall of the housing.

70. The tilt-latch of claim 69 wherein the latch bolt has a second channel in cooperative sliding engagement with the second tongue.

71. A tilt-latch for a sash window disposed within opposed guide rails on a master frame, the sash window comprises a top rail, a base and two stiles connected together at their extremities, the top rail having opposed header slots, the tilt-latch adapted for releaseably securing the sash window to the master frame, the tilt-latch comprising:

a housing adapted to be supported by the top rail, the housing having an outward end opening, the housing further having a first tongue extending therefrom, the tongue having an extending flange;

a latch bolt disposed within the housing and having a nose adapted for engaging a respective one of the guide rails, the latch bolt having a first bolt channel in cooperative sliding engagement with the first tongue and flange, the latch bolt further having a spring wall adjacent the first bolt channel; and, a spring having one end positioned abutting the spring wall and another end abutting the housing wherein the latch bolt is biased through the outward end opening, the flange extending over a length of the spring to partially encapsulate a length of the spring.

72. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and a bottom wall, the housing having a tongue wherein the tongue extends substantially along the entire length of the bottom wall and is spaced from sidewalls of the housing;

a latch bolt disposed within the housing and having a nose adapted for engaging a respective one of tie guide rails, the latch bolt having a channel that receives the tongue, the latch bolt further having a spring wall adjacent the channel; and, a spring having one end positioned abutting the spring wall and another end abutting the housing wherein the latch bolt is biased through the outward end opening, the tongue extending along a length of the spring.

73. The tilt-latch of claim 72 further comprising an actuator connected to the latch bolt.

74. A tilt-latch for a sash window disposed within opposed guide rails on a master frame, the sash window comprises a top rail, a base and two stiles connected together at their extremities, the top rail having opposed header slots, the tilt-latch adapted for releaseably securing the sash window to the master frame, the tilt-latch comprising:

a housing having means for supporting the housing in the header slot, the housing having an outward end opening and an outer edge, the housing further having a cover and a pair of sidewalls depending from the cover, the cover having an elongated opening defining a pair of rails, the housing further having a first tongue extending along a bottom wall of the housing and spaced from the sidewalls, the tongue having a flange extending therefrom, the housing having a second tongue extending from one of the sidewalls;

a latch bolt disposed within the housing and having a nose adapted for engaging a respective one of the guide rails, the latch bolt having a first bolt channel in cooperative sliding engagement with the first tongue and flange and a second bolt channel in cooperative sliding engagement with the second tongue, the latch bolt further having a spring wall adjacent the first bolt channel, the latch bolt further having a post extending therefrom;

a spring having one end positioned abutting the spring wall and another end abutting the housing wherein the latch bolt is biased through the outward end opening, the flange partially encapsulating a length of the spring; and, an actuator having a notch that receives the post wherein the actuator is connected to the latch bolt, the actuator having an actuator channel on opposed longitudinal edges that cooperate with the elongated opening rails wherein the actuator is slideable along the cover and a rear portion of the actuator moves past the outer edge of the housing when retracting the latch bolt into the housing.

75. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening, the housing having a tongue, the tongue having a flange extending transversely from the tongue;

a latch bolt disposed within the housing and having a nose adapted for engaging a respective one of the guide rails, the latch bolt having a channel that receives the tongue and flange; and a spring for biasing the latch bolt through the outward end opening, the tongue and flange partially encapsulating a length of the spring.

76. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and a cover, the cover having an outer edge, the outer edge accommodating a peripheral opening;

a latch bolt disposed within the housing and having a nose adapted for engaging respective one of the guide rails; and an actuator connected to the latch bolt wherein a portion of the actuator moves past the outer edge of the housing by passing through the peripheral opening when retracting the latch bolt into the housing.

77. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening, the housing having a tongue, the tongue comprising a discontinuous rail; and, a latch bolt disposed within the housing and having a nose adapted for engaging a respective one of the guide rails, the latch bolt having a channel that receives the tongue.

* * * * *

UNITED STATES PATENT AND TRADEMARK OFFICE

CERTIFICATE OF CORRECTION

PATENT NO. : 6,155,615
DATED : December 5, 2000
INVENTOR(S) : Steven E. Schultz

It is certified that error appears in the above-identified patent and that said Letters Patent is hereby corrected as shown below:

Column 8,
Line 63, 8E" and insert therefor -- 18 --

Column 12,
Line 21, delete "and" and insert therefor -- arm --

Column 13,
Line 58, delete "is"

Column 16,
Line 42, after "rail" insert -- , --

Column 17,
Line 38, delete "tie" and insert therefor -- the --

Signed and Sealed this

Second Day of October, 2001

*Attest:*

Nicholas P. Godici

NICHOLAS P. GODICI

*Attesting Officer*

*Acting Director of the United States Patent and Trademark Office*